US005845441A

United States Patent [19]

Swartz

[11] Patent Number: 5,845,441

[45] Date of Patent: Dec. 8, 1998

[54] PREMANUFACTURED PORTABLE CONCRETE HOUSE

[76] Inventor: Paul D. Swartz, P.O. Box 41100, Phoenix, Ariz. 85080

[21] Appl. No.: 675,230

[22] Filed: Jul. 1, 1996

[51] Int. Cl.[6] ..... E04B 1/00

[52] U.S. Cl. ..... 52/250; 52/251; 52/79.1

[58] Field of Search ..... 52/250, 251, 253, 52/258, 259, 122.1, 125.1, 220.1, 220.2, 220.3, 79.1, 79.9, 79.11, 295, 293.3, 296, 297

[56] References Cited

U.S. PATENT DOCUMENTS 3,772,835 11/1973 Gox et al. ..... 52/79.11
3,902,287 9/1975 Livingston ..... 52/79.11 X
4,214,408 7/1980 Rich, Jr. ..... 52/79.1
4,443,992 4/1984 Schechter ..... 52/79.1

*Primary Examiner*—Creighton Smith
*Attorney, Agent, or Firm*—Martin L. Stoneman

[57] ABSTRACT

This invention provides a premanufactured portable concrete house and efficient systems for making such a house and for providing portability to a housing site. Floor, roof, and wall components are made by casting concrete in molds with features such as electrical and water conduits being concrete-embedded during the casting. Also concrete-embedded in the various house components are steel plates used for welding to secure the components to each other during assembly of a portable house. Spaced core holes for holding lift rods are cast into the periphery of the floor/foundation component; and these are used as lift points in lifting the house onto a truck for transport to a housing site.

13 Claims, 7 Drawing Sheets

FIG. 1
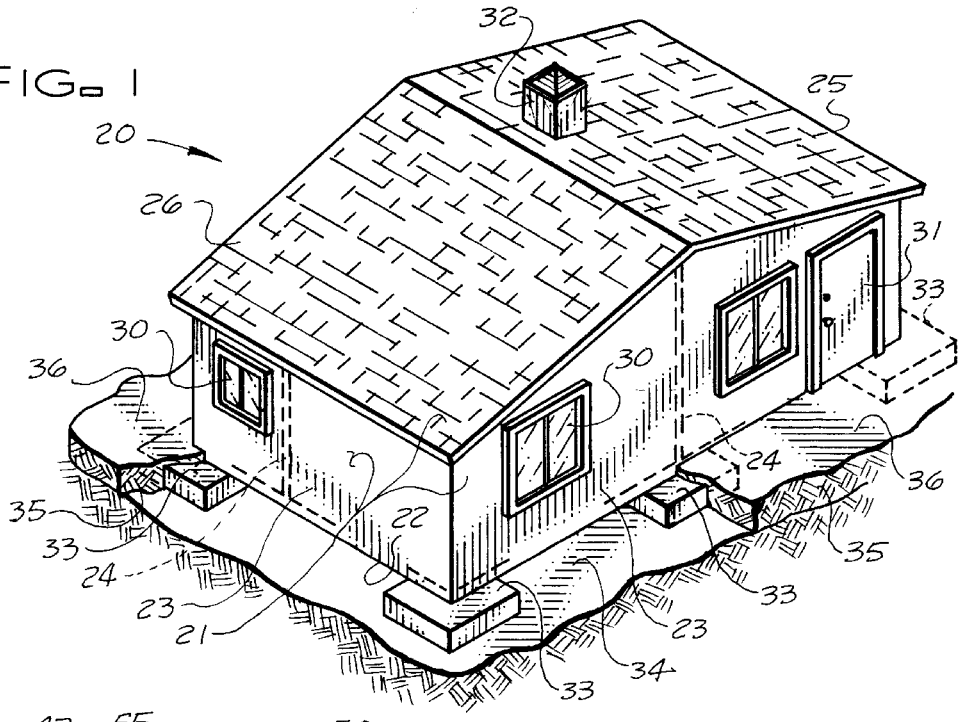
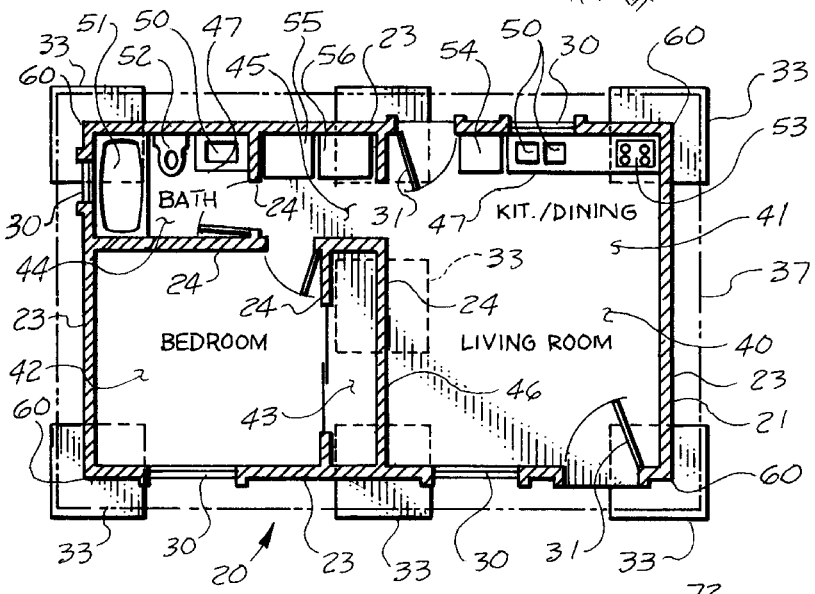
FIG. 2
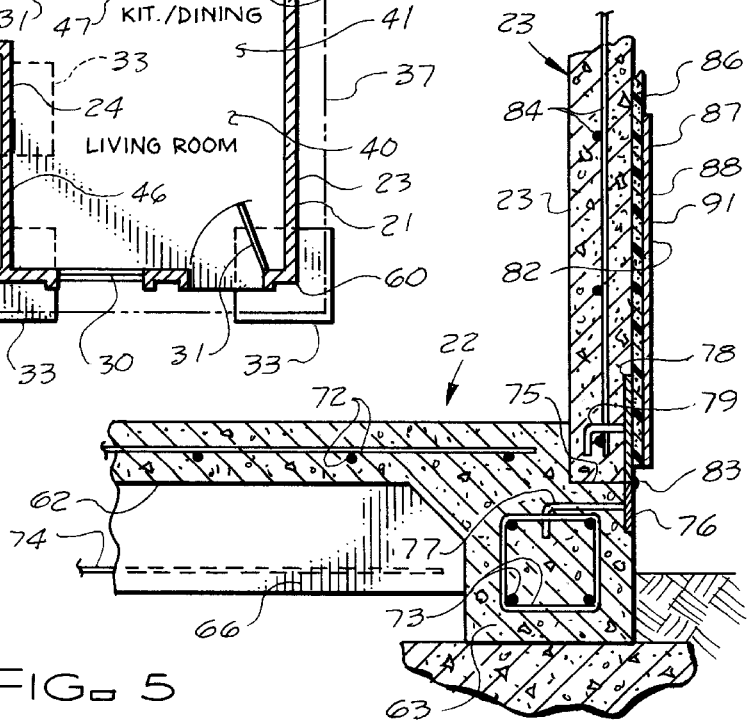
FIG. 5

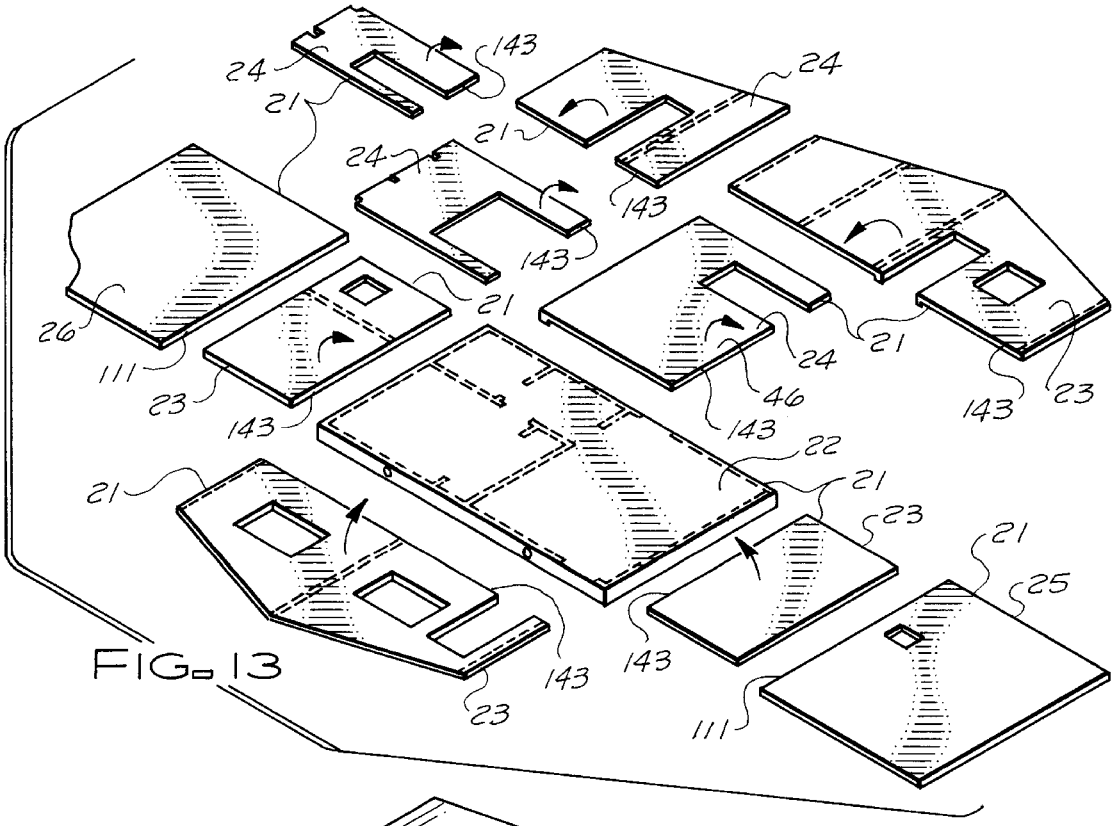
FIG. 13
FIG. 14
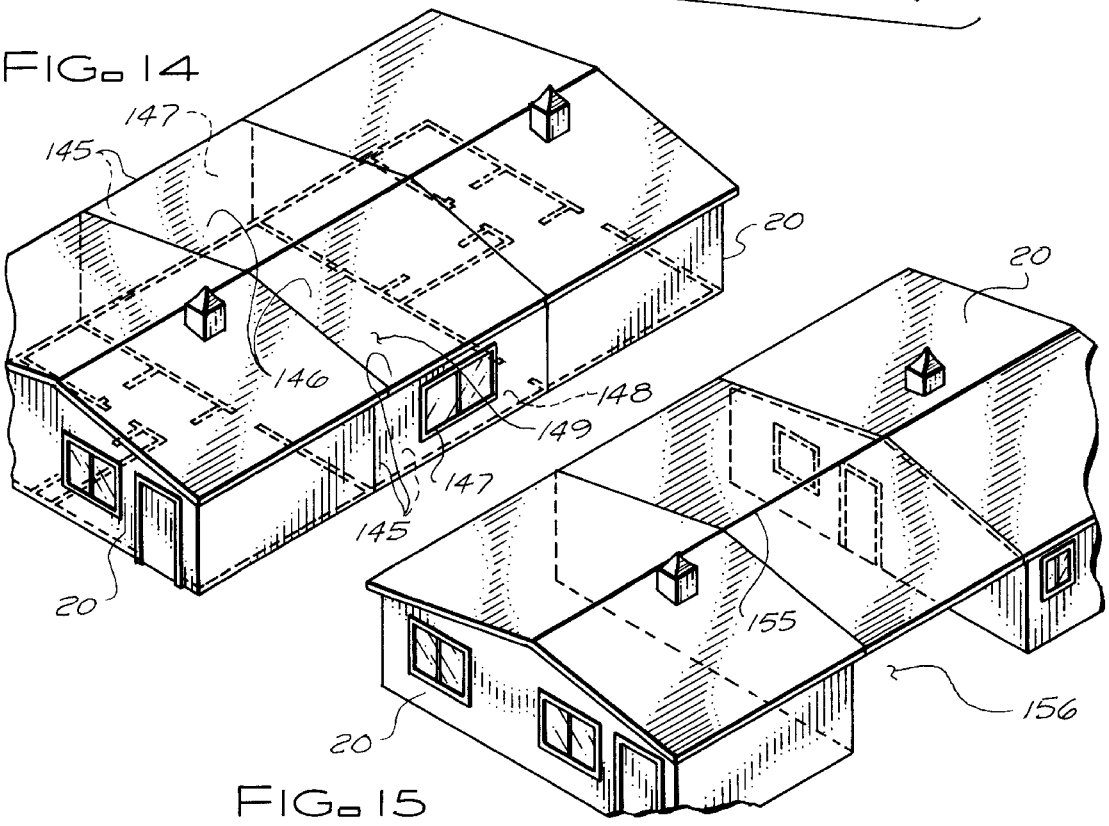
FIG. 15

201
203
204
202

204
201
205
206
203
202

201
207
210
202
208
207
212
201
202

201
204
204
213
214
202

FIG. 16F
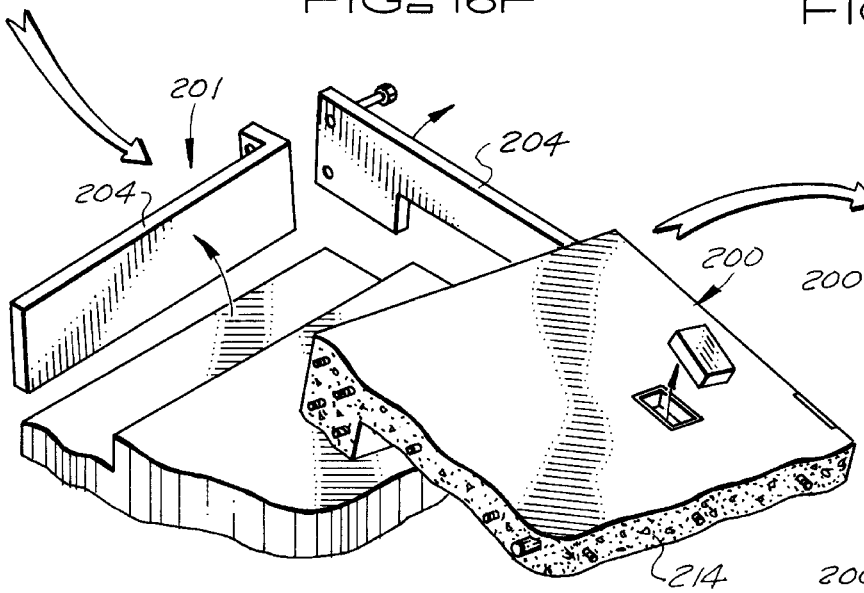
FIG. 16G
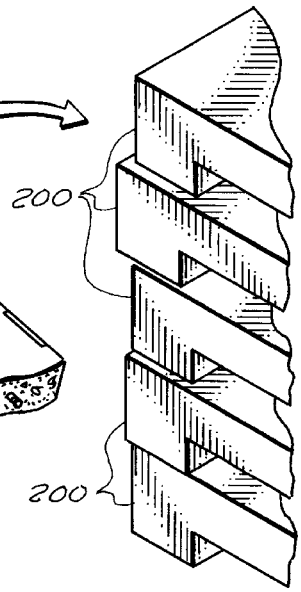
FIG. 17A
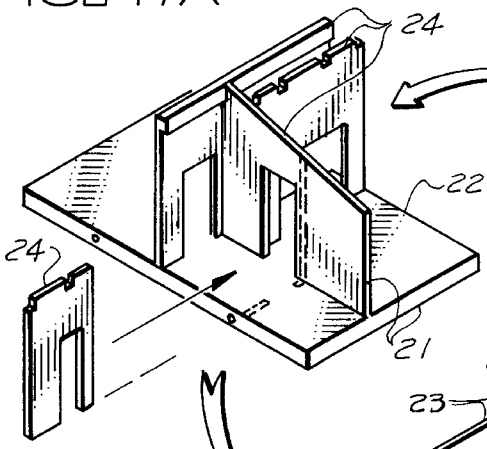
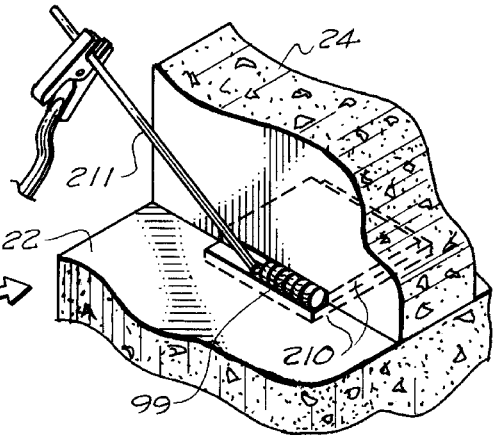
FIG. 17B
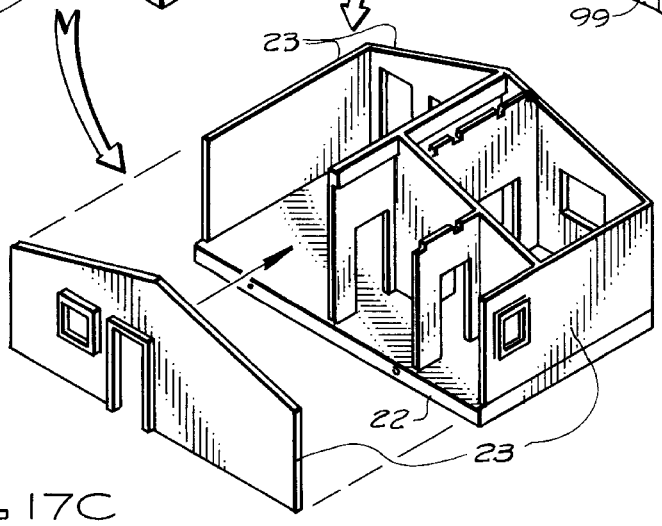
FIG. 17C

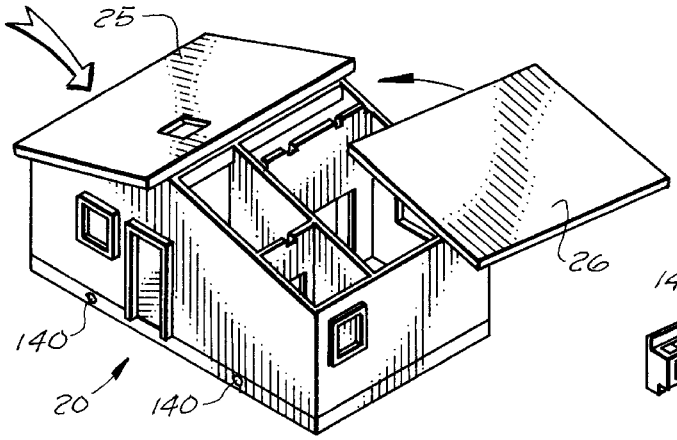
FIG. 17D
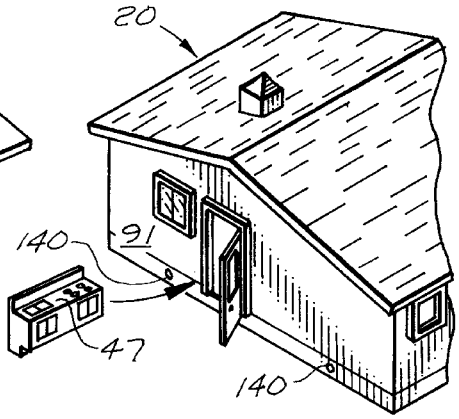
FIG. 18
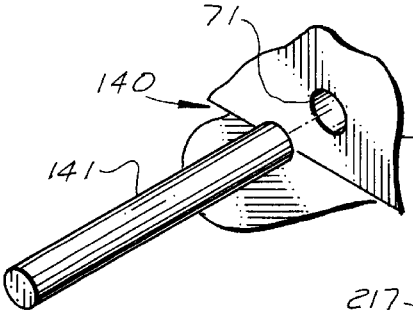
FIG. 19A
FIG. 19B
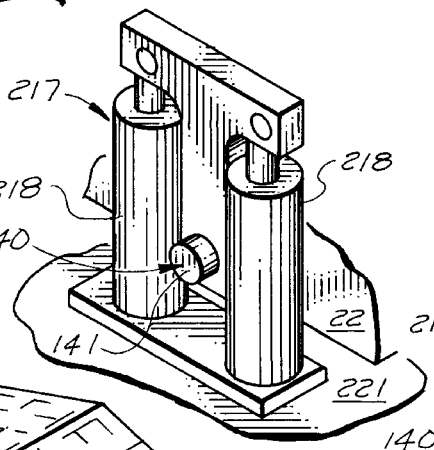
FIG. 19C
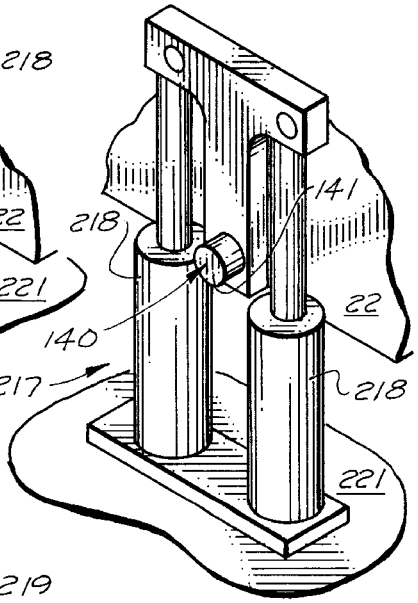
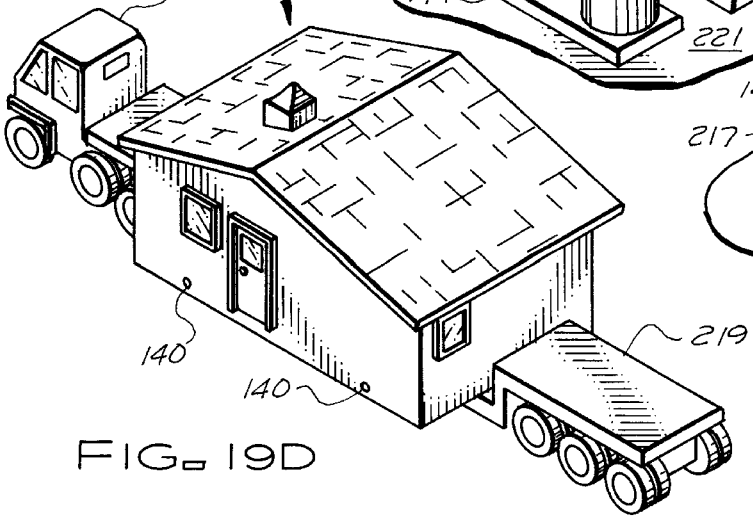
FIG. 19D

PREMANUFACTURED PORTABLE CONCRETE HOUSE

BACKGROUND OF THE INVENTION

1. Field of the Invention

This invention relates to premanufactured portable concrete housing structures. More particularly, this invention concerns a system for providing a premanufactured portable concrete house, for making such a house, and for providing portability to a housing site.

2. Description of the Prior Art

Typically, a concrete house is manufactured or put together right on the site of permanent use for such house. And although a concrete house provides long life, low maintenance, high strength, good insulation, and other advantages to a homeowner, the cost of building such a concrete house on site is more than what low-income families can afford.

Also, typically, mobile homes which are premanufactured of other materials at a mass production location and then transported to and placed on a home site are inexpensive and within the budget of many low-income families. However, such mobile homes are usually of much shorter life, higher maintenance, lower strength, poorer insulation, etc., than what a concrete house would be. And there have been no successful efforts to provide for the needs of such low-income families an efficient and inexpensive system for premanufacturing in a mass production manner a portable concrete house which may be efficiently transported and installed at a home site.

OBJECTS OF THE INVENTION

A primary object of the present invention is to fulfill the above-mentioned needs by the provision of a premanufactured portable concrete house. A further primary object of the present invention is to provide such a house which is efficient and inexpensive. In addition, it is a primary object of this invention to provide a system for making and for transporting for on-site use of such a house. Other objects of this invention will become apparent with reference to the following invention descriptions.

SUMMARY OF THE INVENTION

According to a preferred embodiment of the present invention, this invention provides a premanufactured portable concrete housing structure comprising, in combination: first concrete means for providing a floor member; multiple second concrete means for providing wall members; third concrete means for providing a roof member; and such first concrete means comprising multiple spaced means for assisting lifting and deposit of such premanufactured portable housing structure. Also, it provides such a premanufactured portable concrete housing structure wherein each of such multiple spaced means for assisting lifting and deposit of such premanufactured portable concrete housing structure comprises core means adjacent a side of such first concrete means. And it provides such a premanufactured portable concrete housing structure wherein such core means comprises a horizontal hole substantially perpendicular to such side of such first concrete means; and further, wherein such core means comprises a substantially-cylindrical hole, in a socket beam, adapted for holding a substantially cylindrical rod member adapted for jacking.

Further, the present invention provides such a premanufactured portable concrete housing structure wherein such second concrete means comprises concrete-embedded electrical and water conduits. And it provides such a premanufactured portable concrete housing structure wherein such first concrete means comprises multiple concrete beams strong enough to permanently support such premanufactured portable concrete housing structure on footing members. Additionally, it provides such a premanufactured portable concrete housing structure wherein such first and second concrete means comprise concrete-embedded first attachment means for attaching such first concrete means to each of such second concrete means; and, further, wherein each such first attachment means comprises first steel plate means for welding to an other such first attachment means.

Moreover, the present invention provides such a premanufactured portable concrete housing structure wherein such third concrete means comprises a pair of such roof members connected at a selected pitch by connection means comprising concrete-embedded second steel-plate means for welding to an other such connection means. Also, it provides such a premanufactured portable concrete housing structure wherein such third concrete means comprises second attachment means comprising concrete-embedded third steel-plate means for welding to a roof-member-supporting said second concrete means.

Even further, the present invention provides, in accordance with a preferred embodiment thereof a premanufactured portable concrete housing structure system comprising the steps of: preparing a horizontal concrete-casting mold for the casting of a concrete means for providing a housing structure member; placing into such mold internal steel rebar elements for such concrete means and surface steel plate elements for such concrete means, each such surface steel plate element being supported by dowel means supported by a such steel rebar element; placing concrete into such mold and curing such concrete to provide a solid such housing structure member; removing such housing structure member from such mold; from the above steps using suitable such concrete-casting molds, accumulating such housing structure members in the form of floor members, roof members, and wall members adapted to be connected to provide a premanufactured portable concrete housing structure; from such accumulated such housing structure members, making a premanufactured portable concrete housing structure by successively placing each such housing structure member in suitable juxtaposition to an other such housing structure member and welding together contacting such surface steel plate elements of such juxtaposed housing structure members; transporting such premanufactured portable concrete housing structure to a suitable site; and depositing such premanufactured portable concrete housing structure on such site.

Also, this invention provides such a premanufactured portable concrete housing structure system further comprising the step of, before placing concrete into such mold to make a such floor member, configuring such mold to provide spaced socket beams each including a cylindrical hole adjacent to substantially perpendicular to an edge of such floor member; and, further, comprising the step of, after making a such premanufactured portable concrete housing structure, placing a fitting cylindrical steel rod into each such cylindrical hole in such manner that a portion of such steel rod extending from such hole is adapted to act as a lift point for lifting such premanufactured portable concrete housing structure. It further provides such a premanufactured portable concrete housing structure system further comprising the steps of: after such placing of each such steel rod, placing lifting means under each such steel rod portion extending from a such hole; and lifting such premanufactured portable concrete housing structure; and, further, wherein such transporting is by truck; and, further, wherein such lifting comprises using four such steel rods.

Even additionally, the present invention provides, according to a preferred embodiment thereof, a premanufactured portable ready-to-use concrete house comprising: a precast concrete floor member comprising bottom-portion concrete beams for added support strength, such concrete beams comprising both circumferential beams and internal beams; four precast concrete exterior wall members; two precast concrete roof members each supported by three of such wall members at a pitch angle; an interior bearing wall member further supporting such roof members; and concrete-embedded attachment means in each of such members (such floor member, such exterior wall members, such roof members, and such interior bearing wall member) for attaching each such member to a juxtaposed other member.

Still further, this invention provides such a premanufactured portable ready-to-use concrete house wherein each such attachment means in each such member comprises a steel plate for welding to an other such attachment means of an other such member; and, further, wherein the floor dimensions of such concrete house are about 16 feet by about 28 feet. And it also provides such a premanufactured portable ready-to-use concrete house further comprising: a second house substantially identical to such concrete house and situate spaced from such concrete house about one house-width distant; and spanning roof member means for providing a roof spanning such distance between such concrete house and such second house.

BRIEF DESCRIPTION OF THE DRAWINGS

FIG. 1 is a perspective view of a preferred embodiment of the premanufactured concrete house of the present invention.

FIG. 2 is a floor plan view of a premanufactured concrete house.

FIG. 5 is a cross-section elevation view of floor/foundation and exterior wall construction.

FIG. 13 is a perspective view of the concrete house components prior to assembly.

FIG. 14 is a perspective view of an alternate method of the concrete house's use.

FIG. 15 is a perspective view of a second alternate method of the concrete house's use.

FIG. 17 (FIGS. 17A through 17D) is a series of perspective views showing essentially a preferred system or method of assembling the concrete components or structures into a concrete house.

FIG. 18 is a perspective view illustrative of one of the final steps in a preferred system for completing a concrete house of the present invention.

FIG. 19 is a series of perspective views showing some steps in a preferred system for lifting and transporting a concrete house for deposit at a home site. FIG. 19A shows the insertion of a lift rod into a cored hole at a lift point in a floor/foundation member. FIG. 19B and FIG. 19C show a jacking means operating for lifting at a lift point. FIG. 19D shows a truck transporting a concrete house of the present invention.

DETAILED DESCRIPTION OF A PREFERRED EMBODIMENT AND THE BEST MODE OF PRACTICE

Figure 3:
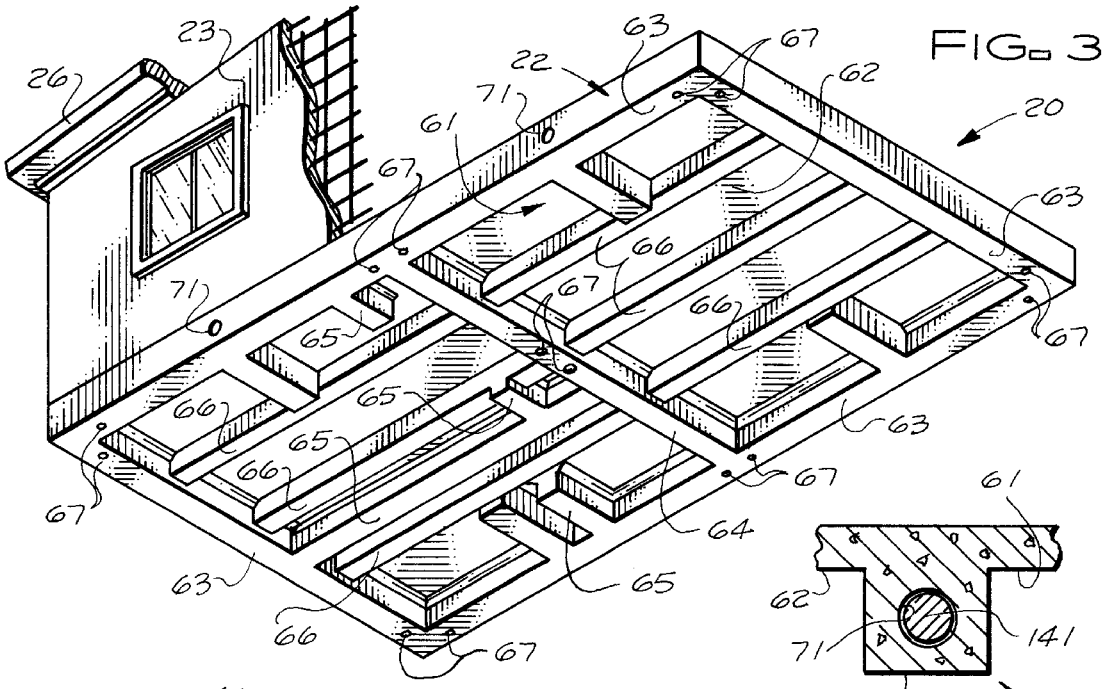
FIG. 3 is a perspective view of the underside of the floor/foundation.

Shown in perspective view in FIG. 1 is a preferred embodiment of a premanufactured portable concrete housing structure, embodied by concrete house 20, according to the present invention. Concrete house 20 would have been previously manufactured at a factory site, where this design of house is manufactured in quantity, and then transported to, and installed at the location where it is to be occupied as a residential dwelling. The concrete house 20 is a completely assembled and ready to use dwelling with its component structures 21 (constructed of steel reinforced concrete members) consisting of first concrete means for providing a floor member, embodied by floor/foundation 22, multiple second concrete means for providing wall members, embodied by exterior walls 23 and interior walls 24, and third concrete means for providing a roof member, embodied by ceiling/roof sections 25 and 26. The assembled structures 21 then preferably incorporate insulating materials and coatings, roofing materials, and interior and exterior paint coatings. Additionally the concrete house 20 preferably includes factory installed windows 30, doors 31, interior cabinetry, hot and cold water and sewer plumbing systems with plumbing fixtures, electrical wiring with outlets, lighting and utility box, and a heating and cooling system with heat pump 32.

The concrete house 20, in its ready to use state, and after being transported to its set-up site, is installed and attached atop seven footings 33 which rest upon an approved base 34. The approved base 34 may be either engineering certified compacted fill or 18 inches below undisturbed soil. After the footings 33 and concrete house 20 are set, fill 35 is brought up to the natural grade 36. Installation of the concrete house 20 is completed with the hook up of water, sewer, electric, and gas if required. As the concrete house 20 will commonly be used as a part of a planned community or defined neighborhood, parking, landscaping, walkways, etc., might generally be installed in conjunction with a group of other concrete houses. The simplicity of set-up and installation of the concrete house 20, as described, will allow for a minimum of time and labor required to bring the concrete house 20 to a habitable state.

As the concrete house 20 has been designed for the goal of maximum economy and longevity by being mass produced at a factory site and then transported to an installation site, the overall size and configuration is also directed towards this goal. As illustrated in FIG. 2, the floor plan view of a preferred floor plan of the concrete house 20 shows the simplicity of the concrete house 20, while maintaining the necessary features of a single family dwelling. The exterior dimensions are approximately 16'-4" by 28'-4" excluding the roof overhang 37 which is a nominal 12" all around and illustrated with dotted lines. This size provides a living area of approximately 480 square feet, yet allows a practical method of construction, and a size suitable for transporting the completed unit to the installation site.

The floor plan of the concrete house 20 includes a living room 40, kitchen/dining area 41, one bedroom 42 with a large closet 43, bathroom 44, and utility area 45. Exterior walls 23 include windows 30 and doors 31. Four interior walls 24 define the rooms with the interior bearing wall 46 located midway of the longitudinal dimension of the concrete house 20, dividing it in half and separating the living room 40 and kitchen/dining area 41 from the bedroom 42, bathroom 44 and utility area 45. This interior bearing wall 46 additionally supports the two ceiling/roof sections where they connect at the roof peak. The remaining three interior walls 24 are non-bearing walls. Cabinets 47 are located in the kitchen/dining area 41 and bathroom 44 and house sinks 50. Additional fixtures include bathtub 51 and water closet 52. Appliances include stove and oven 53, with locations for refrigerator 54, washer 55 and dryer 56.

Additionally, the floor plan illustrates the location of the seven footings 33, on which the concrete house 20 will rest and to which it will be attached at the installation site. A footing 33 will be located at each of the four corners 60, two midway longitudinally where the interior bearing wall 46 joins with the two opposing exterior walls 23, and one located under the center of the concrete house 20. Although not shown, electrical outlets and lighting fixtures are appropriately located throughout the concrete house 20.

The underside 61 of the floor/foundation 22 of the concrete house 20 is shown in perspective in FIG. 3 with portions of an exterior wall 23 and left ceiling/roof section 26 included. The floor/foundation 22, manufactured as one piece of steel reinforced concrete, incorporates (as further discussed just below) multiple concrete beams strong enough to permanently support the premanufactured portable concrete housing structure on footing members. Floor/foundation 22 incorporates a floor slab 62 with integral foundation beams 63 around its perimeter on all four sides and a center foundation beam 64 located midway longitudinally and interconnecting with two opposing foundation beams 63 on the longitudinal sides of the floor. This center foundation beam 64 is located under the location of the interior bearing wall 46. Additionally, non-supporting foundation beams 65 are included under the locations of the remaining interior walls 24. Also supporting the floor slab 62, and integral with it, are support beams 66, spanning the longitudinal length and interconnecting with the foundation beams 63 on the opposing short sides of the floor. These support beams 66 also interconnect with the center foundation beam 64. There are three support beams 66 under each half of the floor slab 62, equally spaced, dividing the floor slab 62 into quarters. Also shown are cored holes 67 through foundation beams 63 and center foundation beam 64 at the locations where the concrete house 20 will rest atop the seven footings 33. These cored holes 67 may be used to attach the concrete house 20 to the footings 33 with mechanical fasteners; but it is noted that, for most such connections, using an angle iron clip (not shown) at each of the exterior footing locations, in well known ways, may be preferable. Additionally located on the underside 61 of the floor slab 62 are four socket beams 70, further described in FIGS. 11 and 12, which contain cored holes 71 for removable lifting rods used while moving the concrete house 20. The cored holes 71 extend through opposing foundation beams 63 and into the socket beams 70 preferably at two locations on each longitudinal side of the floor/foundation 22.

Figure 6:
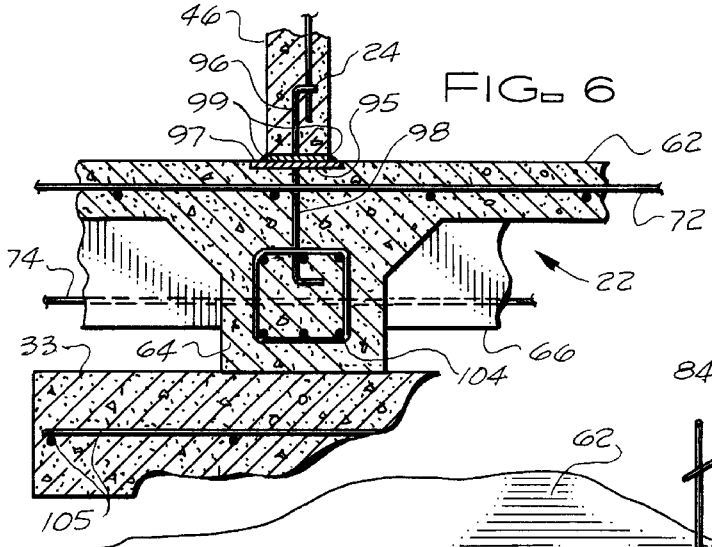
FIG. 6 is a cross-section elevation view of floor/foundation and interior wall construction.
Figure 4:
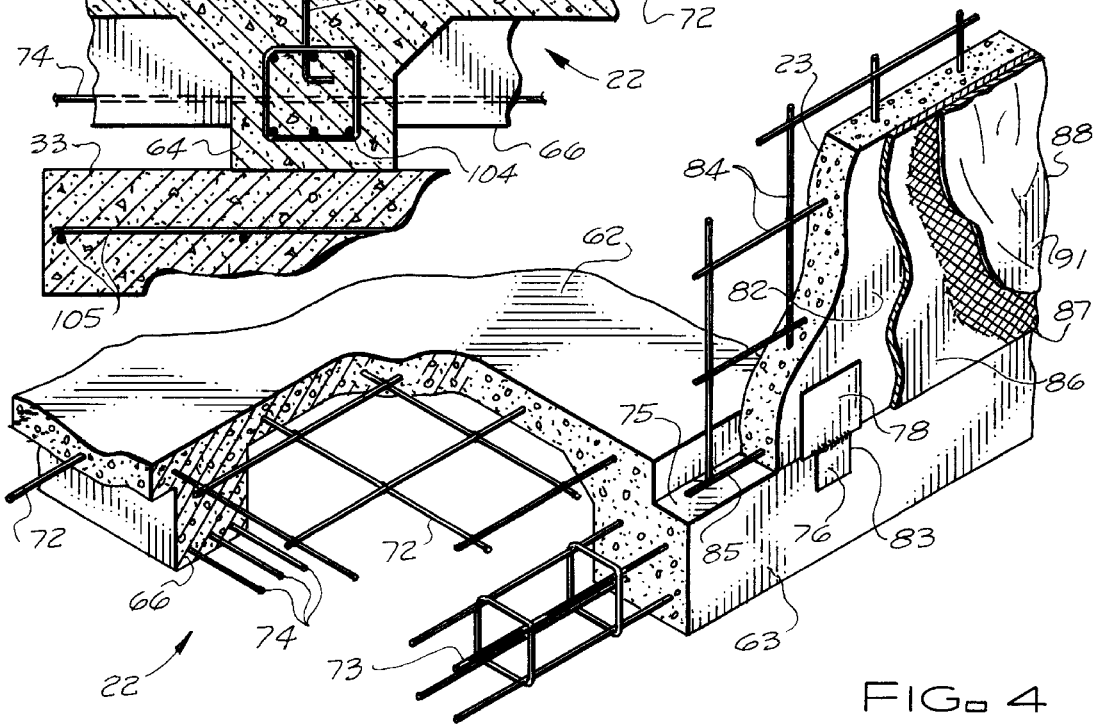
FIG. 4 is a perspective view of typical floor/foundation and wall construction.

Specific details of the features of the floor/foundation 22, along with details of exterior walls 23 and interior walls 24, and attachment of these components, are described in FIGS. 4 through 6. As earlier stated, the floor/foundation 22, exterior walls 23, interior walls 24, and right and left ceiling/roof sections 25 and 26 are manufactured of steel reinforced concrete. These component structures 21 are cast horizontally in casting beds using necessary forms; then, after curing, they are available for assembly and attachment to each other. The casting process is similar to that used for industrial building component construction and involves preparing a casting bed with forms, preparing and positioning reinforcing steel and fittings within the casting bed and forms, and then pouring concrete within the bed and forms. Once poured, the top surface of the concrete is leveled and finished. After the concrete is sufficiently cured, forms are removed and the cast item is lifted from the casting bed. For manufacture of the concrete house 20 in production quantities, casting beds specifically made and provided for each component to be cast and include shapes and forms for all required features, and also provide ease of assembly and disassembly as is necessitated for reuse. The floor/foundation 22 is cast in one piece, with the casting bed and forms configured to produce the foundation beams 63, center foundation beam 64, non-supporting foundation beams 65, support beams 66, socket beams 70 and the underside 61 of the floor slab 62.

The floor slab 62 incorporates a steel reinforcing rod grid 72, and the foundation beams 63 located around the perimeter of the floor slab 62 are reinforced by rebar with ties 73. Additionally, the support beams 66 contain rebar 74. Around the perimeter of the floor/foundation 22 is a recess 75 for positioning of exterior walls 23. As will be herein more particularly described, this invention includes concrete-embedded first attachment means (preferably steel plate means, weldable) for attaching the floor/foundation 22 to each of the various wall elements and similar second attachment means for attaching the roof (25 and 26) to its supporting wall elements. Steel weld plates 76 with dowels 77 are cast into the foundation beams 63 around the outer perimeter spaced approximately 48" apart with their locations corresponding with like weld plates 78, with dowels 79, cast into the outer surface 82 at the bottom edge of exterior walls 23. When the exterior walls 23 are positioned in their appropriate locations in the recess 75 of the foundation beams 63 of the floor/foundation 22, weld plates 76 are joined with weld plates 78, with a weld bead 83, thus securing the exterior walls 23 to the floor/foundation 22.

Exterior walls 23 are cast in casting beds in the same manner as the floor/foundation 22. A steel reinforcing rod grid 84 is again used in the exterior walls 23 with additional rebar 85 around and just inside the perimeter edges, and around door and window openings. When the exterior walls 23 are cast, the outer surface 82 is faced downward, and, prior to pouring the concrete, a layer of insulating foam panels 86 are placed into the casting bed to provide for an insulating barrier on the outer surface 82 of the exterior walls 23. After the various structures 21 are assembled, wire mesh 87 (chicken wire) is secured through the insulating foam panels 86 to the outer surface 82 of the exterior walls 23, and then a layer of stucco 88 is applied. The surface of the stucco 88, along with the remaining exterior of the concrete house 20, receives a final paint coat system 91 with coloring as desired.

In FIG. 6, details of the attachment of the interior bearing wall 46 to the center foundation beam 64 of the floor/foundation 22 is shown. Cast into the bottom surface 94 of the interior bearing wall 46 are weld plates 95, with dowels 96, which are spaced approximately every 48", and mate with the center foundation beam 64 at weld plates 97 incorporating dowels 98. Upon assembly, weld plates 95 and weld plates 97 are joined with weld bead 99 on both sides of interior bearing wall 46. Attachment of other interior walls 24, which are non-bearing, to the floor/foundation 22 at non-supporting foundation beams 65, occurs in the same manner using weld plates with dowels. The center foundation beam 64 with rebar with ties 104 is shown resting atop a footing 33. Footings 33 also incorporate a grid of reinforcing rod 105.

Figure 7:
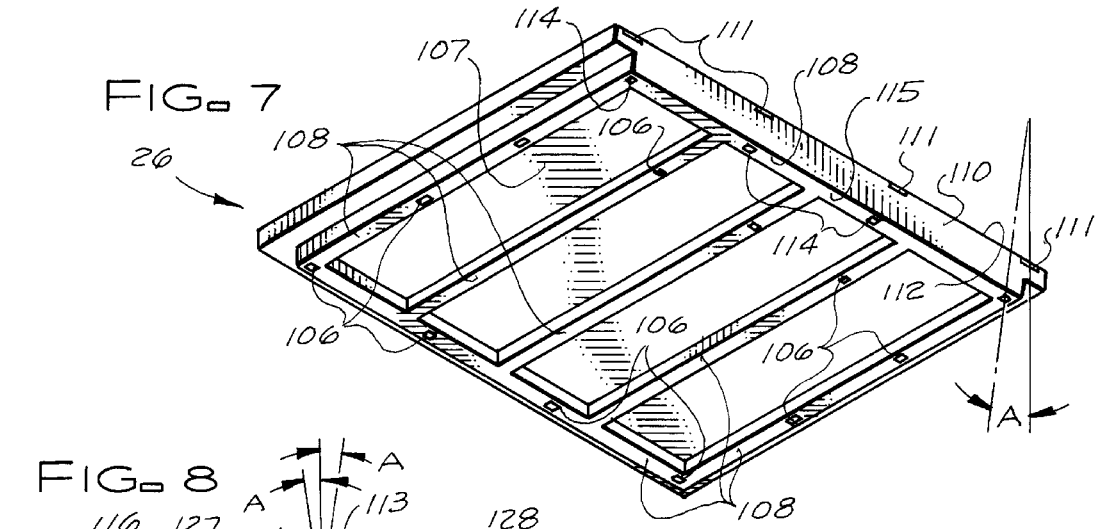
FIG. 7 is a perspective view of the underside of a roof/ceiling section.

The underside of left/ceiling roof section 26 is shown in perspective in FIG. 7. Right ceiling/roof section 25 is identical in construction to left ceiling/roof section 26, with the exception of the location of weld plates 106 and provisions (in the right section) for beams to connect with non-bearing walls (using the steel plate methods described herein), for lighting, for heat pump 32 and for other utilities. Typical for both left and right ceiling/roof sections 26 and 25, is ceiling slab 107 with beams 108. Joining surface 110 is appropriately angled (angle A, as shown) for providing an interface with the opposing roof/ceiling section when installed with an established roof pitch.

Figure 8:
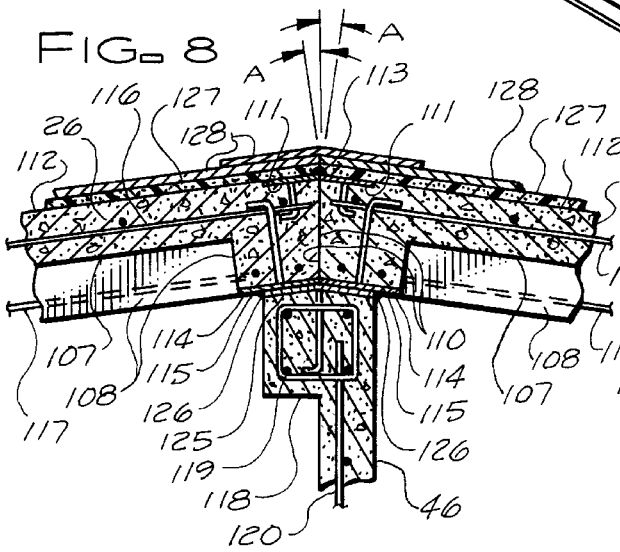
FIG. 8 is a cross-section elevation view of roof/ceiling and interior bearing wall construction including showing the attachment means.

This interface between roof sections 26 and 25 is illustrated in FIG. 8. Weld plates and dowels 111 are cast on the top surface 112 of both left and right ceiling/roof sections 25 and 26, with edges flush with the joining surface 110. When both left and right ceiling/roof sections 26 and 25 are in place and supported atop interior bearing wall 46, weld beads 113 at weld plates and dowels 111 join these two sections. Thus, the roof concrete means comprises a pair of roof members connected at a selected pitch by connection means comprising concrete-embedded steel-plate means for welding to an other similar steel-plate means. The left and right ceiling/roof sections, 26 and 25 are cast with a steel reinforcing rod grid 116 within the ceiling slabs 107 and rebar 117 in the beams 108. Weld plates 114 on the bottom surface 115 of the beams 108 are positioned to mate with corresponding wall weld plates, as shown and discussed below.

Figure 9:
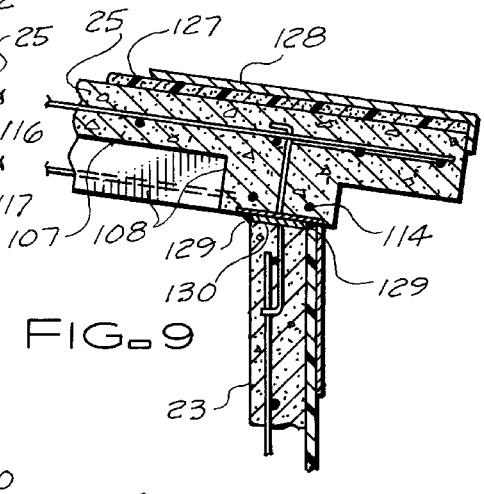
FIG. 9 is a cross-section elevation view of a roof/ceiling and exterior wall construction including showing the attachment means.

At the top of interior bearing wall 46, and extending its full length, is beam 118, cast with rebar with ties 119, which interconnect with a rebar grid 120 which is cast within the interior bearing wall 46. The remaining interior walls within the structure are non-bearing, and do not include beams at their top, but do incorporate a rebar grid. Imbedded at the top of the interior bearing wall 46, in the beam 118 are weld plates 125. When assembled, weld plates 114 on the on the bottom surface 115 of the left and right ceiling/roof sections 26 and 25, are welded to the weld plates 125 with weld beads 126 on both sides of the interior bearing wall 46. This connection means not only secures the left and right ceiling/roof sections 26 and 25 to the interior bearing wall 46, but completes their tie to each other. Completing the roof is a layer of foam insulation 127 and roof covering 128. The roof covering 128 is of conventional materials such as concrete tile or baked enamel metal sheeting, and is secured to the ceiling slabs 107 with mechanical fasteners extending through the foam insulation 127, in well-known ways. In FIG. 9 is illustrated the typical attachment of the left and right ceiling/roof sections, 26 and 25 to an exterior wall 23. Weld plates 114 cast into beams 108 are welded with weld beads 129 to weld plates 130 cast at the top of exterior walls 23. It is noted that, for most applications, roof insulation 127 should be continuous with wall insulation 86, and stucco 87 should connect with the end of roof covering 128, for the best thermal encapsulation and visual appeal. Thus, this invention provides a premanufactured portable concrete housing structure wherein the third concrete means (roof) comprises a second attachment means comprising concrete-embedded third steel-plate means for welding to a roof-member-supporting said second concrete means (wall).

Figure 10:
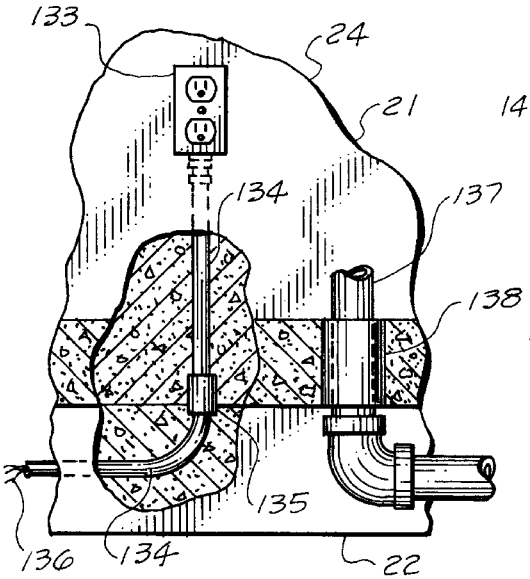
FIG. 10 is cross-section elevation view of typical integral plumbing and electrical.

FIG. 10 shows an example of the common means that typifies the inclusion of electrical, water and sewage lines within and throughout the structure of the concrete house as concrete-embedded electrical and water conduits. Electrical outlet boxes 133 and interconnecting conduit 134 are cast into the interior and exterior walls 23 and 24. Additionally, wall switch boxes, fixtures for lighting, provisions for appliances, and related electrical conduit, are also included. Where interconnecting conduits 134 join at connecting walls, floor/foundation 22 or ceiling roof sections, mechanical connectors 135 are used. After the concrete house 20 has been assembled, the electrical wiring 136 is then pulled through the interconnecting conduit 134. In the same manner, sewer lines 137 and water lines are cast into the exterior walls 23, and floor/foundation 22. Where sewer lines 137 or water lines pass through walls or the floor slab 62, cored holes 138 are provided.

Figure 12:
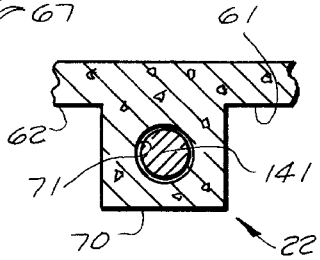
FIG. 12 is a cross-section elevation view of a lifting bar and socket.
Figure 11:
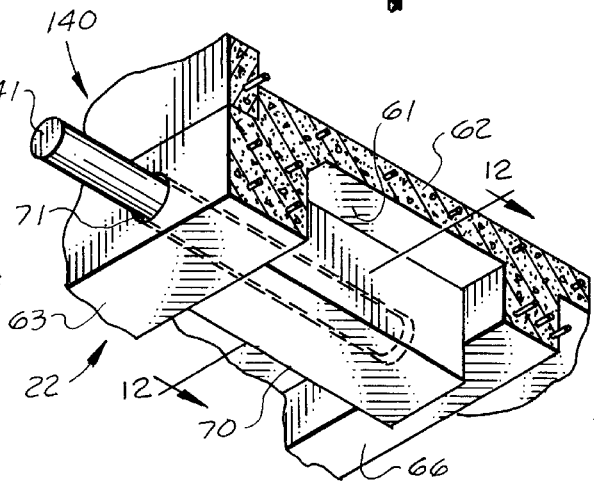
FIG. 11 is a perspective view of a lifting bar and socket.

After the concrete house 20 is assembled, it requires raising and lowering while being transported to the installation site by truck. Multiple spaced means for assisting lifting and deposit of said premanufactured portable housing structure, embodied by four lift points 140 (see FIG. 11), are provided for this purpose. At each lift point 140, a removable lift rod 141, of round steel, is inserted into core means adjacent a side of floor/foundation 22, embodied (as shown) by the substantially cylindrical cored hole 71, a horizontal hole substantially perpendicular to such side of floor/foundation 22. Lift rod 141 is a substantially cylindrical rod member adapted for jacking, and the remaining extending portion (from the cored hole) of the lift rod is an attachment location for a jacking means. A socket beam 70 is cast on the underside 61 of the floor slab 62 of the floor/foundation 22 at each of the lift points. The socket beam 70 extends from the foundation beam 63 to a support beam 66 providing maximum support. The cored hole 71 is slightly larger in diameter than a lift rod 141 and passes through the foundation beam 63 into the socket beam 70. A cross-section elevation view through the section 12—12 of FIG. 11 is shown in FIG. 12. A socket beam 70, on the underside 61 of the floor slab 62, is shown, with a lift rod 141 in the cored hole 71.

In FIG. 13 is a perspective view of the steel reinforced concrete components of the various components or structures 21 of the concrete house 20 prior to assembly. Dotted lines shown on the components indicate the locations where mating components are to be attached. Secured to the floor/foundation 22 are the interior walls 24 and exterior walls 23. The interior wall 24 which supports the roof weight is the interior bearing wall 46. Interior and exterior walls 24 and 23 attach to the floor/foundation 22, on their bottom edge 143. Left and right ceiling/roof sections 26 and 25 join at their joining surfaces 111 and attach to all walls.

An alternate method of usage of the concrete house 20 is shown in a perspective view in FIG. 14. Two concrete houses 20 are utilized together with connecting sections 145 to produce a single enlarged house with approximately triple the square footage. The new large room 149 may be used as the living room or a family room. The use of the other existing rooms may be redefined to best suit the needs of the occupying family. The interior wall/floor plan is illustrated with dotted lines. The connecting sections 145 required include two ceiling/roof sections 146, two exterior wall sections 147, and a floor/foundation 148. A second alternate method of the concrete house's 20 use is shown in FIG. 15. Two concrete houses 20 are located and spaced an appropriate distance apart to be joined at the roofs with a supplemental roof span 155 to provide a breezeway 156. This breezeway 156 may be used by the residents of the two concrete houses 20 as a common utility or patio area. Thus, the present invention provides, as shown, a premanufactured portable ready-to-use concrete house comprising: a second house substantially identical to such concrete house and situate spaced from such concrete house about one house-width distant; and spanning roof member means for providing a roof spanning such distance between such concrete house and such second house.

Figures 16A, 16B, 16C, 16D, 16E:
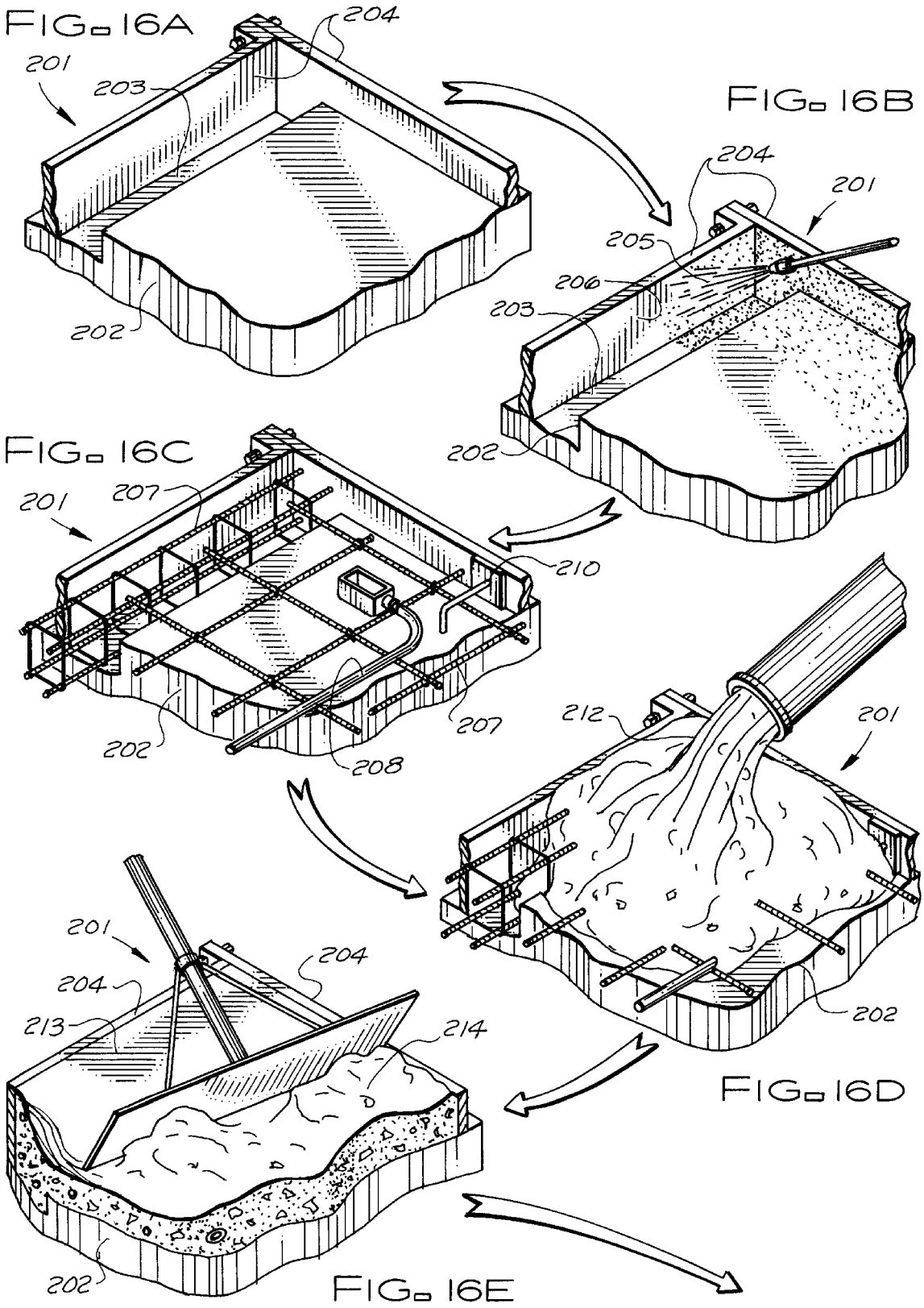
FIG. 16 (FIGS. 16A through 16G) is a series of perspective views showing essentially a preferred system or method of making the concrete house's concrete components or structures.

Described in the views of FIG. 16 (i.e., FIGS. 16A through 16 G) is the preferred common method of manufacturing a typical steel reinforced concrete component 200 that will be used as one of the various kinds of concrete structures 21 of the concrete house 20. FIG. 16A shows a portion of a casting bed 201 used for the manufacture of a typical steel reinforced concrete component 200 of the concrete house 20. The casting bed 201, commonly made of concrete, is used as a mold to reproduce a cast concrete component with the features, shapes, and sizes desired. The casting bed shown incorporates a base 202, recessed feature 203, and removable forms 204. Thus, a step in the system of the present invention is preparing a horizontal concrete-casting mold for the casting of a concrete means for providing a housing structure member. In FIG. 16B the interior surfaces 206 of the casting bed 201 and removable forms 204 are sprayed with a mold release agent 205 to prevent the cast concrete component from sticking to the interior surfaces 206 and complicating removal after curing.

Shown in FIG. 16C is the casting bed 201 with typical steel reinforcing bars 207, weld plate 210, and electrical conduit 208, with each of these items positioned where they are required to be located in the completed cast concrete component. Thus, another step in the system of the present invention is placing into a such mold internal steel rebar elements for such concrete means and surface steel plate elements for such concrete means, each such surface steel plate element being supported by dowel means supported by a such steel rebar element. An important further step in making the floor/foundation 22 is, before placing concrete into such mold to make a such floor member, configuring such mold to provide spaced socket beams each including a cylindrical hole adjacent to substantially perpendicular to an edge of such floor member (for holding the lifting-point rods, as hereinbefore described. In FIG. 16D, freshly mixed concrete 212 is poured into the prepared casting bed 201, flowing into all recesses and around all features. The top surface 213 of the freshly poured concrete 214 is leveled to the top of the removable forms 204 and then smoothly finished as in FIG. 16E. Thus, another step in the system of the present invention is placing concrete into such mold and curing such concrete to provide a solid such housing structure member. As shown in FIG. 16F, the removable forms 204 are removed after the concrete 214 has cured 1 to 2 days and the cast concrete component 200 is removed from the casting bed 201. FIG. 16G shows the completed steel reinforced concrete components 200 (i.e., the concrete structures 21) of the concrete house 20, being stored until further needed. Thus, another step in the system of the present invention is, from the above steps using suitable such concrete-casting molds, accumulating such housing structure members in the form of floor members, roof members, and wall members adapted to be connected to provide a premanufactured portable concrete housing structure.

As shown in the views of FIG. 17 (i.e., FIGS. 17A through 17D), the steel reinforced concrete components 200 (structures 21) are assembled, completing the essential assembly of the concrete house 20. Starting with FIG. 17A, assembly of the steel reinforced concrete structures/components 21 begins with the positioning of the interior walls 24 on the floor/foundation 22 and the subsequent welding together (weld rod 211 forming a weld bead 99) of the weld plates 210 of these components as illustrated in FIG. 17B. After the interior walls 24 are installed, the exterior walls 23 are placed in position and welded in place on the floor/foundation 22 as in FIG. 17C. As shown in FIG. 17D, after wall assembly is completed, the right and left ceiling/roof sections 25 and 26 are positioned and welded in place and to each other, completing essential assembly of the concrete house 20. Thus, another step in the system of the present invention is, from such accumulated such housing structure members, making a premanufactured portable concrete housing structure by successively (1) placing each such housing structure member in suitable juxtaposition to an other such housing structure member, and (2) welding together contacting such surface steel plate elements of such juxtaposed housing structure members.

In FIG. 18, the concrete house 20 receives its electrical wiring, plumbing fixtures, caulking of seams, stucco, paint coat system 91, insulation and roof covering, utilities, cabinets 47, windows, doors, and all items necessary to bring the concrete house 20 to a completed state. The completed concrete house 20 will be transported to the installation site where it will be mounted on footings and connections to utility services rendering it ready for habitation.

As shown in the views of FIG. 19 (i.e., FIGS. 19A through 19D), the concrete house 20, at its manufacturing site, is elevated for placement upon a tractor trailer for transportation. At the installation site it will be lowered to the preset footings. As illustrated in FIG. 19A, a lift rod 141 is inserted into a cored hole 71 at each of the four lift points 140 within the floor/foundation 22. A jacking means 217 is connected to each of the projecting lift rods 141. The jacking means 217 shown in FIGS. 19B and 19C represents a device operated with hydraulic cylinders 218. An identical jacking means is used at all four lift points 140. FIG. 19B shows the jacking means 217 at a lift point 140 with the concrete house 20 resting on the ground 221. FIG. 19C shows the concrete house 20 lifted up from the ground level. The concrete house 20 is elevated sufficiently for a trailer 219 to be positioned underneath. FIG. 19D illustrates the concrete house 20 resting upon the trailer 219 being pulled by tractor 220.

At the installation site, the concrete house 20 is raised above the trailer 219 with the jacking means 217 so that the trailer 219 can be withdrawn. The concrete house 20 is then lowered to the footings 33 (see FIG. 1). It is noted that, in order to make the concrete house of the present invention strong enough for unitary portability without injury, each of the concrete structures 21 is very firmly tied to the other such concrete structures in juxtaposition with it using the described method and structure of juxtaposed concrete-embedded weldable steel plates.

Thus, it is seen that the system of this invention includes the steps of: transporting such premanufactured portable concrete housing structure to a suitable site; and depositing such premanufactured portable concrete housing structure on said site; and, further, it includes the steps of, after placing of each steel rod at the lifting points provided, placing lifting means under each steel rod portion extending from a lifting-point hole; and lifting such premanufactured portable concrete housing structure.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A premanufactured portable concrete housing structure comprising, in combination:

a. first concrete means for providing a floor member;

b. multiple second concrete means for providing wall members;

c. third concrete means for providing a roof member; and d. said first concrete means comprising multiple spaced means for assisting lifting and deposit of said premanufactured portable concrete housing structure;

e. wherein each of said multiple spaced means for assisting lifting and deposit of said premanufactured portable concrete housing structure comprises core means adjacent a side of said first concrete means;

f. wherein said core means comprises a horizontal hole substantially perpendicular to said side of said first concrete means; and g. wherein said core means comprises a substantially-cylindrical hole, in a socket beam, adapted for holding a substantially cylindrical rod member adapted for jacking.

2. A premanufactured portable concrete housing structure comprising, in combination:

a. first concrete means for providing a floor member;

b. multiple second concrete means for providing wall members;

c. third concrete means for providing a roof member; and d. said first concrete means comprising multiple spaced means for assisting lifting and deposit of said premanufactured portable concrete housing structure;

e. wherein said first and second concrete means comprise concrete-embedded first attachment means for attaching said first concrete means to each of said second concrete means; and f. wherein each said first attachment means comprises first steel plate means for welding to an other said first attachment means.

3. A premanufactured portable concrete housing structure comprising, in combination:

a. first concrete means for providing a floor member;

b. multiple second concrete means for providing wall members;

c. third concrete means for providing a roof member; and d. said first concrete means comprising multiple spaced means for assisting lifting and deposit of said premanufactured portable concrete housing structure;

e. wherein said third concrete means comprises a pair of said roof members connected at a selected pitch by connection means comprising concrete-embedded second steel-plate means for welding to an other said connection means.

4. A premanufactured portable concrete housing structure according to claim 3 wherein said third concrete means comprises second attachment means comprising concrete-embedded third steel-plate means for welding to a roof-member-supporting said second concrete means.

5. A premanufactured portable concrete housing structure system, using housing structure members formed as floor members, roof members, and wall members for connection to provide a premanufactured portable concrete housing structure, comprising the steps of:

a. preparing a horizontal concrete-casting mold for casting a concrete means for providing a said housing structure member;

b. placing into said mold internal steel rebar elements for said concrete means and surface steel plate elements for said concrete means, each said surface steel plate element being supported by dowel means supported by a said steel rebar element;

c. placing concrete into said mold and curing said concrete to provide a solid said housing structure member;

d. removing said housing structure member from said mold;

e. from the above steps, using suitable said concrete-casting molds, accumulating said housing structure members, formed as floor members, roof members, and wall members;

f. from said accumulated said housing structure members, making a premanufactured portable concrete housing structure by successively i. placing each said housing structure member in suitable juxtaposition to an other said housing structure member, and ii. welding together contacting said surface steel plate elements of said juxtaposed housing structure members;

g. transporting said premanufactured portable concrete housing structure to a suitable site; and h. depositing said premanufactured portable concrete housing structure on said site.

6. A premanufactured portable concrete housing structure system according to claim 5 further comprising the step of:

a. before placing concrete into said mold to make a said floor member, configuring said mold to provide spaced socket beams each including a cylindrical hole adjacent to and substantially perpendicular to an edge of said floor member.

7. A premanufactured portable concrete housing structure system according to claim 6 further comprising the step of:

a. after making a said premanufactured portable concrete housing structure, placing a fitting cylindrical steel rod into each said cylindrical hole in such manner that a portion of said steel rod extending from said hole acts as a lift point for lifting said premanufactured portable concrete housing structure.

8. A premanufactured portable concrete housing structure system according to claim 7 further comprising the steps of:

a. after said placing of each said steel rod, placing lifting means under each said steel rod portion extending from a said hole; and b. lifting said premanufactured portable concrete housing structure.

9. A premanufactured portable concrete housing structure system according to claim 8 wherein said transporting is by truck.

10. A premanufactured portable concrete housing structure system according to claim 8 wherein said lifting comprises using four said steel rods.

11. A premanufactured portable ready-to-use concrete house comprising:

i. a precast concrete floor member comprising bottom portion concrete beams for added support strength, said concrete beams comprising both circumferential beams and internal beams;

j. four precast concrete exterior wall members;

k. two precast concrete roof members each supported by three of said wall members at a pitch angle;

l. an interior bearing wall member further supporting said roof members; and m. concrete-embedded attachment means in each of said members (said floor member, said exterior wall members, said roof members, and said interior bearing wall member), attaching each said member to a juxtaposed other member;

n. wherein each said attachment means in each said member comprises a steel plate welded to an other said attachment means of an other said member.

12. A premanufactured portable ready-to-use concrete house according to claim 11 wherein said floor member is about 16 feet wide by about 28 feet long.

13. A premanufactured portable ready-to-use concrete house according to claim 11 further comprising:

a. a second house substantially identical to said concrete house and situate spaced from said concrete house about one house-width distant; and b. spanning roof member means for providing a roof spanning said distance between said concrete house and said second house.

* * * * *